US011572720B2

(12) United States Patent
Sultan

(10) Patent No.: US 11,572,720 B2
(45) Date of Patent: Feb. 7, 2023

(54) ADJUSTABLE THRESHOLD ASSEMBLY

(71) Applicant: THE BOEING COMPANY, Chicago, IL (US)

(72) Inventor: Saif Sultan, Bothell, WA (US)

(73) Assignee: THE BOEING COMPANY, Chicago, IL (US)

( * ) Notice: Subject to any disclaimer, the term of this patent is extended or adjusted under 35 U.S.C. 154(b) by 1210 days.

(21) Appl. No.: 16/037,075

(22) Filed: Jul. 17, 2018

(65) Prior Publication Data

US 2020/0024876 A1 Jan. 23, 2020

(51) Int. Cl.

| | |
|---|---|
| ***E05B 85/04*** | (2014.01) |
| ***E05B 83/16*** | (2014.01) |
| ***E05B 79/02*** | (2014.01) |
| ***E05C 9/18*** | (2006.01) |

(52) U.S. Cl.

CPC ..... *E05B 85/04* (2013.01); *E05B 79/02* (2013.01); *E05B 83/16* (2013.01); *E05C 9/1808* (2013.01); *E05C 2009/1816* (2013.01); *Y10T 292/68* (2015.04); *Y10T 292/683* (2015.04); *Y10T 292/685* (2015.04); *Y10T 292/688* (2015.04); *Y10T 292/694* (2015.04)

(58) Field of Classification Search

CPC ..... E05B 85/04; E05B 79/02; E05B 83/16; E06B 1/70; B60J 5/00; E05C 9/1808; E05C 2009/1816; Y10T 292/68; Y10T 292/683; Y10T 292/685; Y10T 292/688; Y10T 292/694; Y10T 292/705

See application file for complete search history.

(56) References Cited

U.S. PATENT DOCUMENTS 1,738,702 A * 12/1929 Haseltine ..... E05C 9/1808 292/7
1,760,187 A * 5/1930 Brenne ..... E05C 9/1808 49/276
2,042,024 A * 5/1936 Schlage ..... E05B 15/0205 292/341.18
2,255,860 A * 9/1941 Riedel ..... E05B 17/2003 292/340
2,568,983 A * 9/1951 Best ..... E05B 15/0205 220/477
2,765,189 A * 10/1956 Forssellericg ..... E05B 83/10 292/340
3,095,021 A * 6/1963 Schlage ..... B27F 5/12 30/167.1
3,113,797 A * 12/1963 Westerdale ..... E05C 9/1808 292/137

(Continued)

*Primary Examiner* — Christine M Mills
*Assistant Examiner* — Faria F Ahmad
(74) *Attorney, Agent, or Firm* — Patterson + Sheridan, LLP

(57) ABSTRACT

A closet unit for a vehicle and a threshold assembly for use with a door are provided. The threshold assembly includes a threshold body that is coupleable to a frame of the closet unit with the threshold body including an opening formed therethrough. The threshold assembly further includes a striker component, in which the striker component includes a plate removably coupleable to the threshold body and a cup coupled to and offset from a center of the plate with the cup positionable through the opening of the threshold body. The threshold assembly further includes a fastener to removably couple the plate of the striker component to the threshold body.

17 Claims, 5 Drawing Sheets

(56) References Cited

U.S. PATENT DOCUMENTS 3,241,873 A * 3/1966 Russell ..... E05B 15/0205 292/341.18
3,287,055 A * 11/1966 Schlage ..... E05B 15/0255 292/341.12
4,005,890 A * 2/1977 Murch ..... E05B 15/0205 292/346
4,065,162 A * 12/1977 Schlage ..... E05B 15/0205 292/340
4,105,235 A * 8/1978 Thiel ..... E05B 15/0245 292/341.18
4,171,836 A * 10/1979 St. Aubin ..... E05B 15/0245 292/341.18
4,186,954 A * 2/1980 Detlefs ..... E05B 15/0205 292/340
5,118,151 A * 6/1992 Nicholas, Jr. ..... E05B 15/0245 29/437
5,127,690 A * 7/1992 Kim ..... E05B 15/0245 292/340
5,171,050 A * 12/1992 Mascotte ..... E05B 15/025 292/340
5,172,946 A * 12/1992 Dowling ..... E05B 83/16 292/216
5,247,817 A * 9/1993 Korner ..... E05B 63/20 292/DIG. 14
5,257,841 A * 11/1993 Geringer ..... E05B 45/083 292/340
5,295,720 A * 3/1994 Budde ..... E05B 81/22 292/201
5,757,269 A * 5/1998 Roth ..... E05B 45/083 200/61.68
5,990,579 A * 11/1999 Ricci ..... E05B 47/0047 307/117
6,089,627 A * 7/2000 Pearson ..... E05B 15/0205 292/DIG. 60
6,588,155 B1 * 7/2003 Theune ..... E05B 15/0245 49/504
6,837,527 B1 * 1/2005 Laurenzana ..... E05B 15/0205 292/340
8,769,875 B1 * 7/2014 Scoggins ..... E06B 1/70 49/467
10,227,800 B2 * 3/2019 Trussler ..... E05C 9/1808
2015/0033633 A1 * 2/2015 Tarrega Lloret ..... E06B 7/16 49/406
2015/0292841 A1 * 10/2015 Fultz ..... F41H 5/24 89/36.04
2016/0177603 A1 * 6/2016 Sims ..... E05C 9/063 292/101
2017/0058592 A1 * 3/2017 Meeks ..... E06B 7/2312
2017/0226787 A1 * 8/2017 Sprague ..... E06B 1/70
2018/0266168 A1 * 9/2018 Jetton ..... E06B 1/70
2018/0283060 A1 * 10/2018 Trussler ..... H02B 1/28
2018/0355665 A1 * 12/2018 Seuberling ..... E06B 7/2307

* cited by examiner

ADJUSTABLE THRESHOLD ASSEMBLY

TECHNICAL FIELD

Embodiments of the present disclosure relate to an adjustable threshold assembly, such as for use with a door, or a closet unit, particularly in a vehicle.

BACKGROUND

Doors and interior closets within a vehicle, such as an aircraft, a train, an automobile, a bus, and/or a boat, are used to secure loads during transit of the vehicle. These doors and closets, however, may stick or jam, such as by having the loads move within the vehicle during transit, or from having components of the vehicle itself bend or move from transit (e.g., a fuselage of an aircraft bending during transit). A threshold assembly and a striker plate may be adjustable to avoid such sticking and jamming. However, such threshold assemblies and striker plates may be overly complicated and expensive, potentially resulting in other inconveniences.

SUMMARY

The systems, methods, apparatus, and devices of the disclosure each have several aspects, no single one of which is solely responsible for its desirable attributes. Without limiting the scope of this disclosure as expressed by the claims which follow, some features will now be discussed briefly. After considering this discussion, and particularly after reading the section entitled "Detailed Description" one will understand how the features of this disclosure provide advantages that include adjustability for a threshold assembly.

In one embodiment, a closet unit for a vehicle is disclosed. The closet unit includes a housing including a frame and a door configured to move with respect to the frame, a latching mechanism coupled to the door and including a latch configured to secure the door to the frame, and a threshold assembly coupled to the housing and configured to receive the latch of the latching mechanism. The threshold assembly includes a threshold body coupled to the frame and a striker component removably coupled to the threshold body and including a plate and a cup coupled to the plate with the cup offset from a center of the plate.

In another embodiment, a threshold assembly for use with a door is disclosed. The threshold assembly includes a threshold body configured to be coupled to a frame of the closet unit and including an opening formed therethrough. The threshold assembly further includes a striker component that includes a plate configured to be removably coupled to the threshold body and a cup coupled to and offset from a center of the plate with the cup configured to be positioned through the opening of the threshold body.

In yet another embodiment, a threshold assembly is disclosed. The threshold assembly consists essentially a threshold body configured to be coupled to a frame of the closet unit and includes an opening formed therethrough. The threshold assembly further consists essentially a striker component and a fastener configured to removably couple the plate of the striker component to the threshold body. The striker component includes a plate configured to be removably coupled to the threshold body and a cup coupled to and offset from a center of the plate with the cup configured to be positioned through the opening of the threshold body.

Embodiments generally include methods, apparatus, and systems, as substantially described herein with reference to and as illustrated by the accompanying drawings. Numerous other aspects are provided.

To the accomplishment of the foregoing and related ends, the one or more aspects comprise the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

BRIEF DESCRIPTION OF ILLUSTRATIONS

So that the manner in which the above-recited features of the present disclosure can be understood in detail, a more particular description, briefly summarized above, may be had by reference to aspects, some of which are illustrated in the appended drawings. It is to be noted, however, that the appended drawings illustrate only certain typical aspects of this disclosure and are therefore not to be considered limiting of its scope, for the description may admit to other equally effective aspects.

To facilitate understanding, identical reference numerals have been used, where possible, to designate identical elements that are common to the figures. It is contemplated that elements described in one aspect may be beneficially utilized on other aspects without specific recitation.

DETAILED DESCRIPTION

Figure 1:
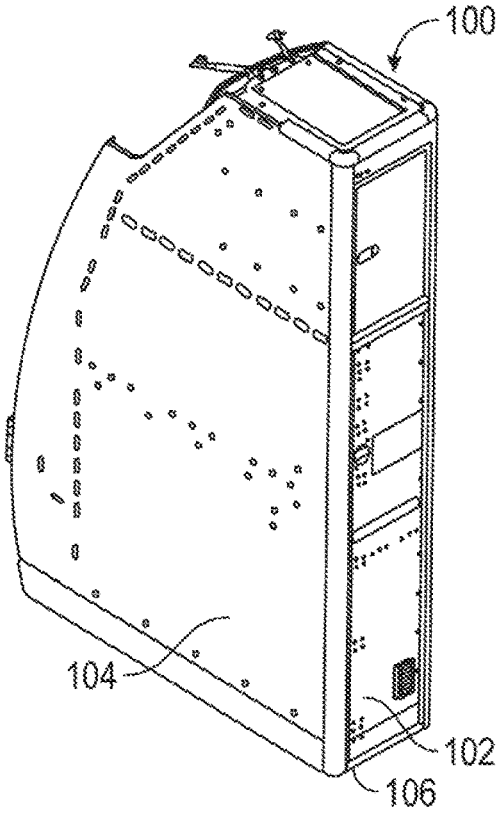
FIG. 1 is an above perspective view of a closet unit including a door in accordance with one or more embodiments of the present disclosure.

Aspects of the present disclosure provide apparatus, systems, and methods, for monitoring process water within a food processing system.

In the following, reference is made to embodiments presented in the present disclosure. However, the scope of the present disclosure is not limited to specific described embodiments. Instead, any combination of the following features and elements, whether related to different aspects or not, is contemplated to implement and practice contemplated aspects. Furthermore, although embodiments disclosed herein may achieve advantages over other possible solutions or over the prior art, whether or not a particular advantage is achieved by a given aspect is not limiting of the scope of the present disclosure. Thus, the following embodiments, features, and advantages are merely illustrative and are not considered elements or limitations of the appended claims except where explicitly recited in a claim(s). Likewise, reference to "the invention" or "the disclosure" shall not be construed as a generalization of any inventive subject matter disclosed herein and shall not be considered to be an element or limitation of the appended claims except where explicitly recited in a claim(s).

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

Vehicles often include doors and closets units for securing loads during transit. However, the doors or closet units may stick or become jammed from the movement of the load during transit, or even movement of a component within the vehicle itself. In accordance with one or more embodiments of the present disclosure, a threshold assembly is provided for use with such doors and closet units, such as to prevent sticking or jamming of the doors or closet units within the vehicle. The threshold assembly includes one or more components that may be adjustable. In particular, the threshold assembly includes a striker component that is removably coupleable to a threshold body, in which the striker component may be arrangeable in a first orientation or a second orientation with respect to the threshold body for adjustability purposes.

Figure 2:
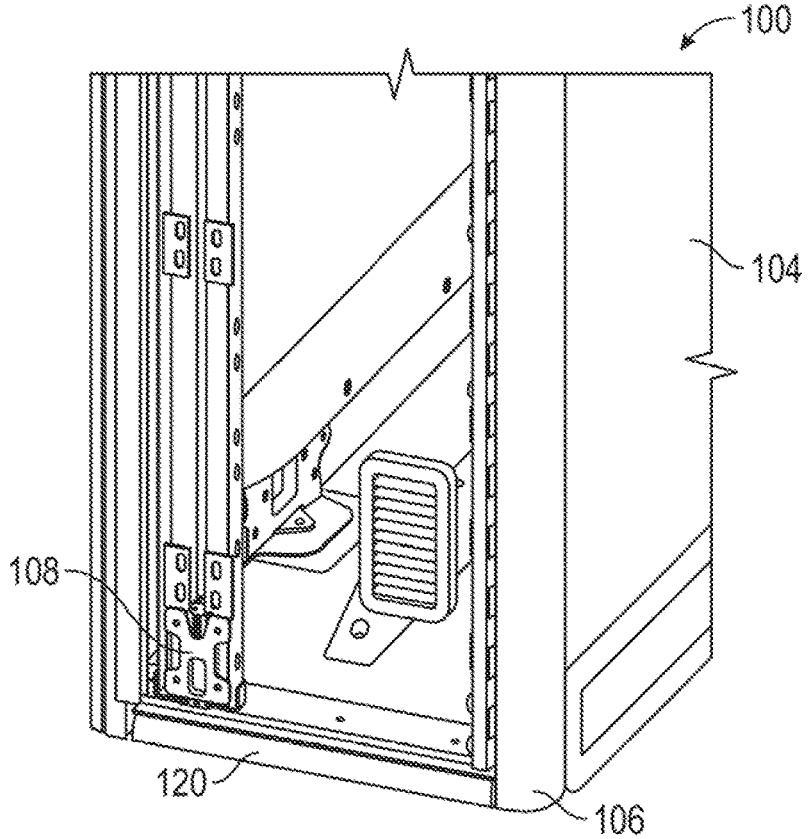
FIG. 2 is a front perspective view of the closet unit in accordance with one or more embodiments of the present disclosure.
Figure 3:
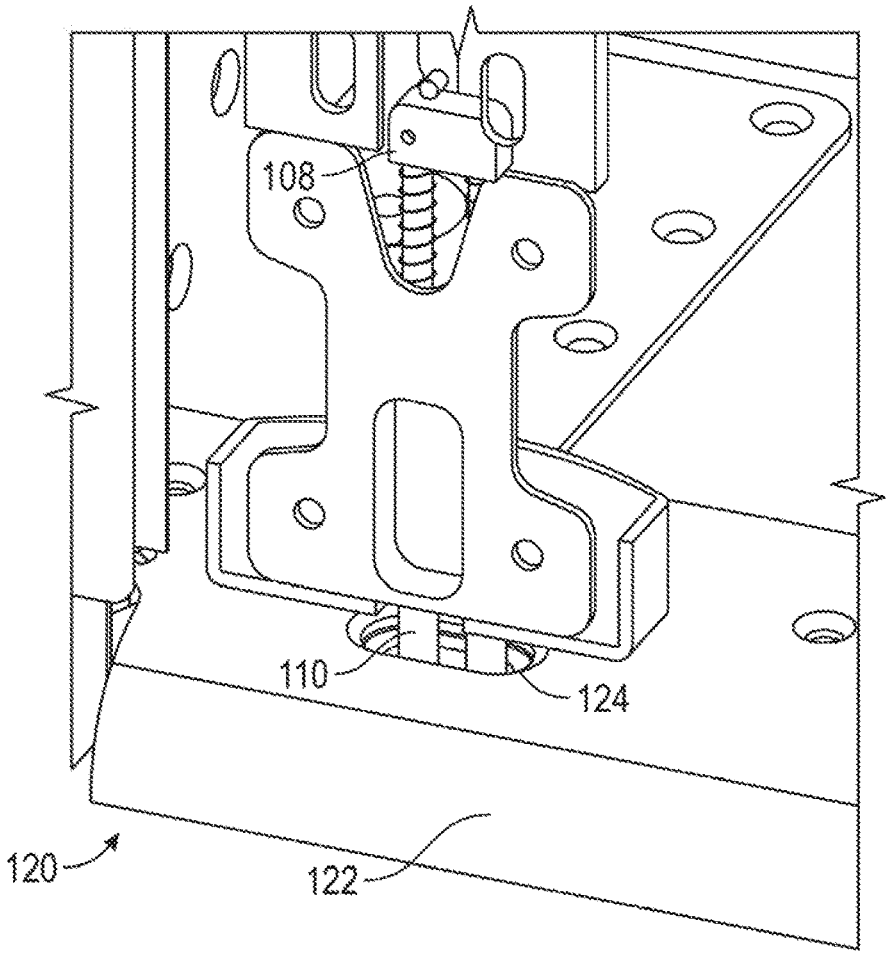
FIG. 3 is a front detailed view of a latching mechanism and a threshold assembly in accordance with one or more embodiments of the present disclosure.
Figure 4:
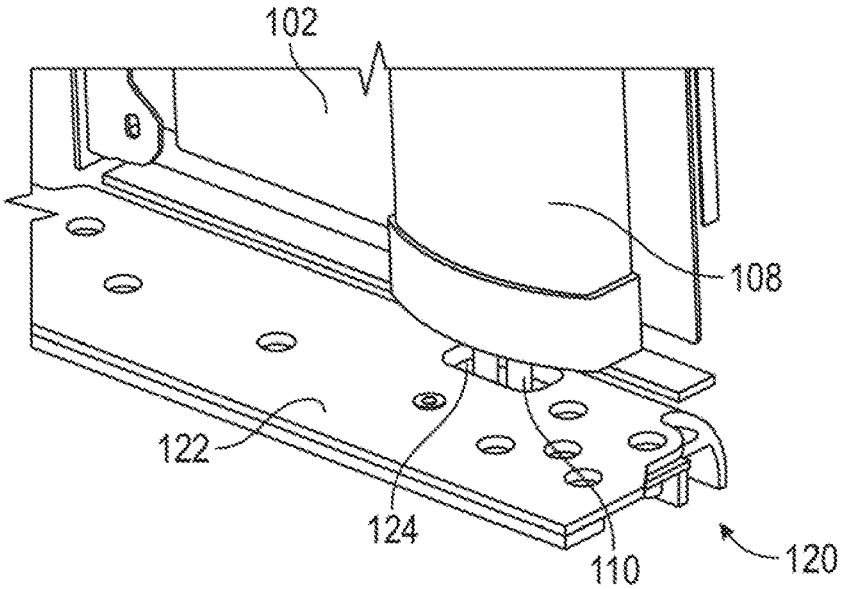
FIG. 4 is a back detailed view of the latching mechanism and the threshold assembly in accordance with one or more embodiments of the present disclosure.

FIGS. 1-4 show multiple views of a closet unit 100 or a door 102 used within a vehicle in accordance with one or more embodiments of the present disclosure. FIG. 1 is an above perspective view of the closet unit 100 including the door 102 and FIG. 2 is a front perspective view of the closet unit 100 with the door 102 removed for clarity. Further, FIG. 3 is a front detailed view of a latching mechanism 104 and a threshold assembly 120 used with the door 102 (the door 102 again removed for clarity) within the closet unit 100, and FIG. 4 is a back detailed view of the latching mechanism 104 and the threshold assembly 120.

With reference to FIGS. 1-4, the closet unit 100 includes the door 102, and in this embodiment, the closet unit 100 may be portable or removable from a vehicle. The closet unit 100 includes a housing 104 with a frame 106 and the door 102 movable with respect to the frame 106. For example, the door 102 may move, such as rotate or translate (e.g., slide), between an open position and a closed position with respect to the frame 106 of the housing 104. In the open position, the door 102 enables a load (e.g., items) to be positioned within or removed from the housing 104, and in the closed position, the door 102 secures the load within the housing 104.

A latching mechanism 108 is used to secure the door 102 to the frame 106, such as when the door 102 is in the closed position. The latching mechanism 108 is shown as coupled to the door 102 and includes a latch 110. The latch 110 is movable with respect to the door 102 to selectively engage and be received by the threshold assembly 120. In particular, the latch 110 is movable between a latched position and an unlatched position with respect to the door 102 and/or the threshold assembly 120. In the latched position, the latch 110 of the latch mechanism 108 may engage or be received within the threshold assembly 120 to secure the door 102 in the closed position. In the unlatched position, the latch mechanism 108 enables the door 102 to move between the open position and the closed position. In this embodiment, the latch mechanism 108 is shown as a rotary latch and the latch 110 is shown as a pin or a rod that is received by the threshold assembly 120.

The threshold assembly 120 is coupled to the housing 104 of the closet unit 100. More particularly, the threshold assembly 120 includes a threshold body 122 that is coupled to or along the frame 106 of the closet unit 100. The threshold body 122 includes an opening 124 formed therethrough, in which the latch 110 is shown as received within the opening 124. The latch 110 is received within the opening 124 to secure the door 102 to the frame 106, such as when the latch 110 is in the latched position and the door 102 is in the closed position.

Figure 5:
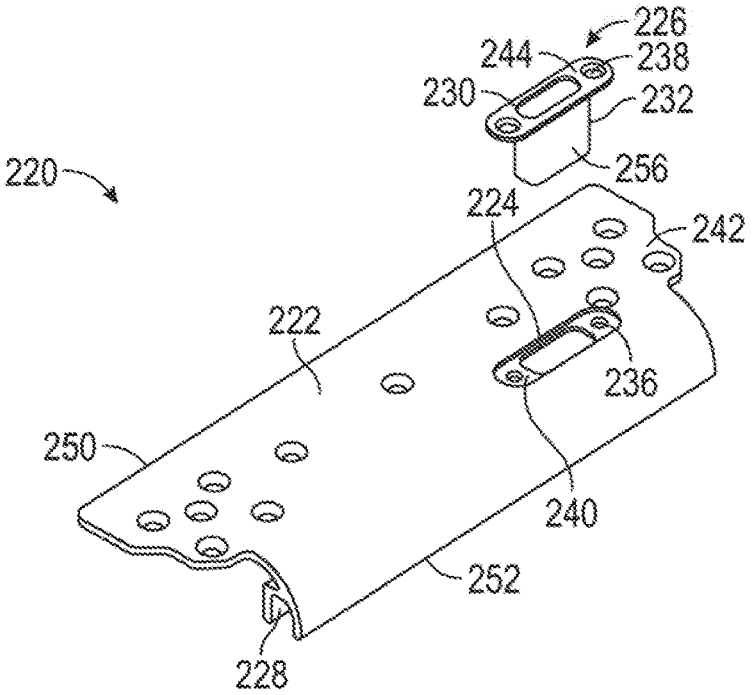
FIG. 5 is an exploded view of a threshold assembly in accordance with one or more embodiments of the present disclosure.
Figure 6:
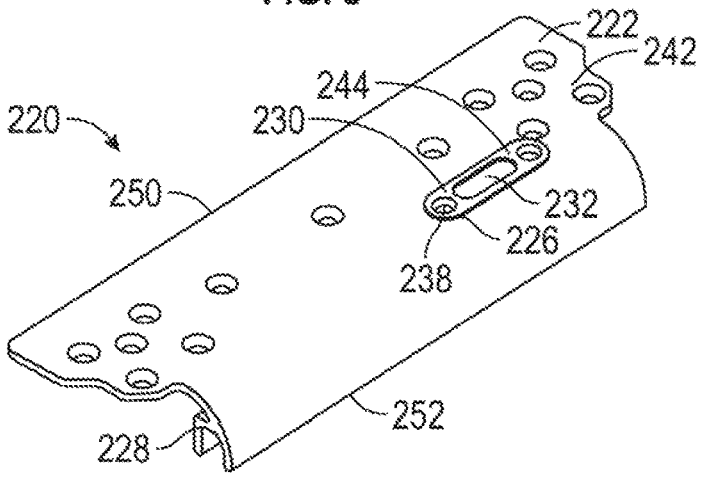
FIG. 6 is a perspective view of the threshold assembly in accordance with one or more embodiments of the present disclosure.
Figure 7:
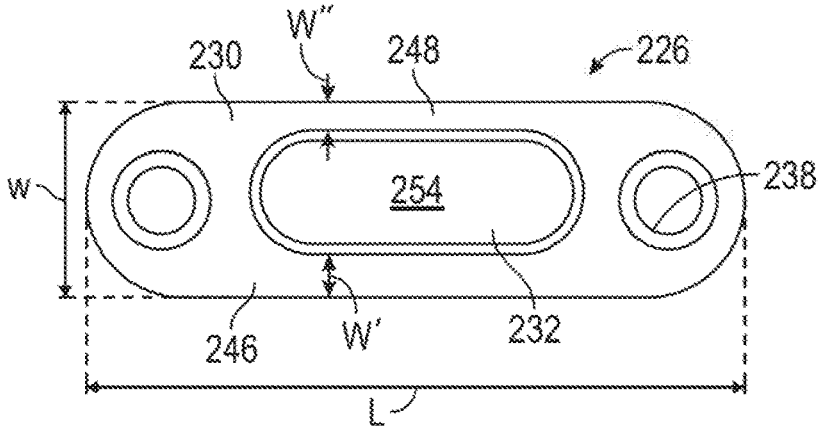
FIG. 7 is a top down view of a striker component in accordance with one or more embodiments of the present disclosure.

FIGS. 5-7 show multiple views of a threshold assembly 220 and components thereof in accordance with one or more embodiments of the present disclosure. The threshold assembly 220, which may be used similarly to the threshold assembly 120 shown above in FIGS. 1-4, includes a threshold body 222 and a striker component 226. FIG. 5 shows an exploded view of the threshold assembly 220 with the threshold body 222 and the striker component 226 disassembled and separate from each other, and FIG. 6 shows a perspective view of the threshold assembly 220 assembled and the threshold body 222 and the striker component 226 coupled to each other. Further, FIG. 7 shows a top down view of the striker component 226.

The threshold body 222, as shown, includes an attachment mechanism 228 to facilitate coupling the threshold body 222 to the frame 106 of the closet unit 100. In this embodiment, the attachment mechanism 228 is integrally formed with the threshold body 222, though the present disclosure is not so limited, and includes a snap-fit feature to be able to couple the threshold body 222 to the frame 106. The threshold body 222 further includes an opening 224 formed therethrough, such as to receive the latch 110 of the latch mechanism 108 discussed above.

The striker component 226 includes a plate 230 and a cup 232 coupled to the plate 230. The plate 230 and the cup 232 may be integrally formed with each other, as shown here, or may be formed separately and then coupled to each other. The striker component 226 is removably coupleable to the threshold body 222. For example, the striker component 226 may be coupled to the threshold body 222 such that the cup 232 of the striker component 226 is positionable or extends through the opening 224 of the threshold body 222. As such, the cup 232 may be used to receive the latch 110 of the latch mechanism 108.

Further, the threshold body 222 may include a recess 240 to facilitate coupling the striker component 226 to the threshold body 222. As shown particularly in FIG. 5, a recess 240 is positioned adjacent the opening 224 and/or surrounding the opening 224, such as by having the recess 240 formed within an upper surface 242 of the threshold body 222. The plate 230 of the striker component 226 is then positioned within the recess 240. In such an embodiment, an upper surface 244 of the plate 230 may be co-planar with the upper surface 242 of the threshold body 222.

Figure 8:
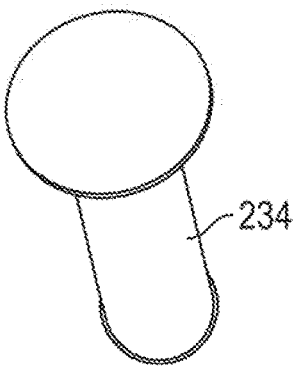
FIG. 8 is a perspective view of a fastener in accordance with one or more embodiments of the present disclosure.

One or more fasteners 234 may be used to removably couple the striker component 226 to the threshold body 222. The threshold body 222 includes one or more apertures 236 formed therethrough, such as formed in the recess 240, and the plate 230 of the striker component 226 includes one or more corresponding apertures 238 formed therethrough. A fastener 234, such as a pin, an example of which is shown in FIG. 8, may be positioned through the aperture 236 of the threshold body 222 and the corresponding aperture 238 of the striker component 226 to removably couple the striker component 226 to the threshold body 222.

As shown best in FIG. 7, the striker component 226 includes the cup 232 positioned offset from a center of the plate 230. In this embodiment, the plate 230 includes a length L and a width W. The cup 232, or more particularly a center of the cup 232, is offset from a center of the plate 230, or more particularly offset from the center of the width W in this embodiment. The cup 232 being offset from the center of the plate 230 defines a larger width portion 246 for the plate 230 on one side of the cup 232 and a smaller width portion 248 for the plate 230 on the opposite side of the cup 232. The larger width portion 246 has a width W', and the smaller width portion 248 has a width W". With the cup 232 offset from the center of the plate 230, the width W' of the larger width portion 246 is larger or wider than the width W" of the smaller width portion 248. As the latch of the latching mechanism may not be received centrally within the cup 232, the latch may be positioned adjacent or abut the smaller width portion 248 of the plate 248 for the cup 232 to accommodate the latch. Additionally or alternatively, the cup 232 may be offset from a center of the length L of the plate 230 to define a larger length portion on one side of the cup 232 and a smaller length portion on the opposite side of the cup 232. In such an embodiment, a length of the larger length portion is larger or longer than a length of the smaller length portion.

As the striker component 226 is removably coupled to the threshold body 222, the striker component 226 may be uncoupled from the threshold body 222 and recoupled to the threshold body 222 in different orientations, such as to adjust the position of the striker component 226 with respect to the threshold body 222. For example, the striker component 226 may be removably coupled to the threshold body 222 in a first orientation and a second orientation with respect to the threshold body 222. In such an embodiment, the striker component 226 may be rotated by about 180 degrees between the first orientation and the second orientation. In particular, the threshold body 222 may include an internal side 250 and an external side 252, such as opposite sides of the opening 224. In the first orientation for the striker component 226, the larger width portion 246 of the plate 230 is positioned closer to the internal side 250 of the threshold body 222 than the smaller width portion 248 of the plate 230. In the second orientation for the striker component 226, the smaller width portion 248 of the plate 230 is positioned closer to the internal side 250 of the threshold body 222 than the larger width portion 246 of the plate 230.

By having the striker component 226 selectively movable between different orientations with respect to the threshold body 222, the cup 232 of the striker component 226 may be adjusted, as desired, within the threshold assembly 220. For example, the position of the cup 232 may be adjusted with respect to the threshold body 222, such as to modify or adjust tolerances or engagement between the cup 232 and the latch 110 received within the cup 232. This adjustable engagement between the cup 232 and the latch 110 may be used to prevent having the latch mechanism 108 stick or jam, such as by having the latch 110 stick or jam within the cup 232. Further, the cup 232 may be adjusted with respect to the respect to the threshold body 222, and thus the latching mechanism 108 and the door 102, by removing the striker component 226 from the threshold body 222, rotating the striker component 226 with respect to the threshold body 222, and then coupling the striker component 226 back to the threshold body 222.

The opening 224 of the threshold body 222 is larger than an outer surface of the cup 232. For example, for the opening 224 to accommodate the cup 232 in the first orientation and the second orientation, the cross-sectional area of the opening 224 is larger than the cross-sectional area of the outer surface of the cup 232. In FIGS. 5-7, the cup 232 includes a lower planar surface 254 and an outer surface 256. In this embodiment, the cross-sectional area of the opening 224 is larger than the cross-sectional area of the outer surface 256 of the cup 232. The cup 232, as shown, includes a rounded rectangular cross-sectional shape. Further, the plate 230, as shown, includes a rounded rectangular cross-sectional shape. However, the plate 230 and the cup 232 are not so limited, as the plate 230 and/or the cup 232 may include other cross-sectional shapes, such as elliptical, circular, rectangular, or polygonal, without departing from the scope of the present disclosure.

Figure 9:
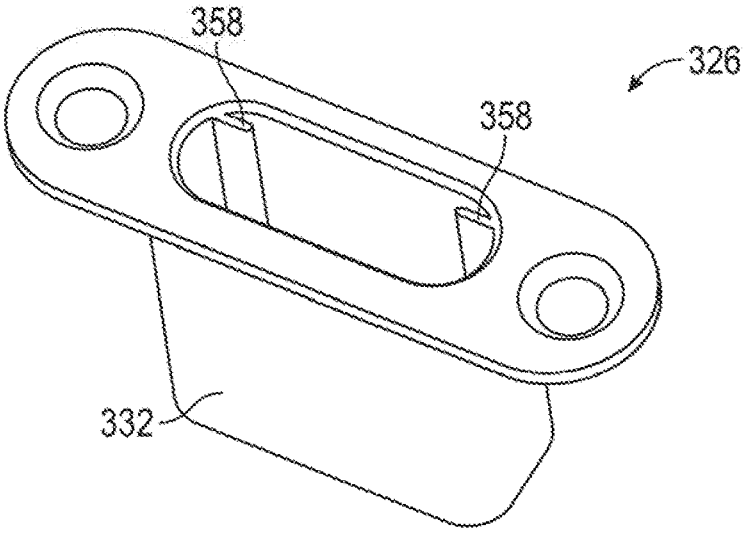
FIG. 9 is a perspective above view of a striker component in accordance with one or more embodiments of the present disclosure.
Figure 10:
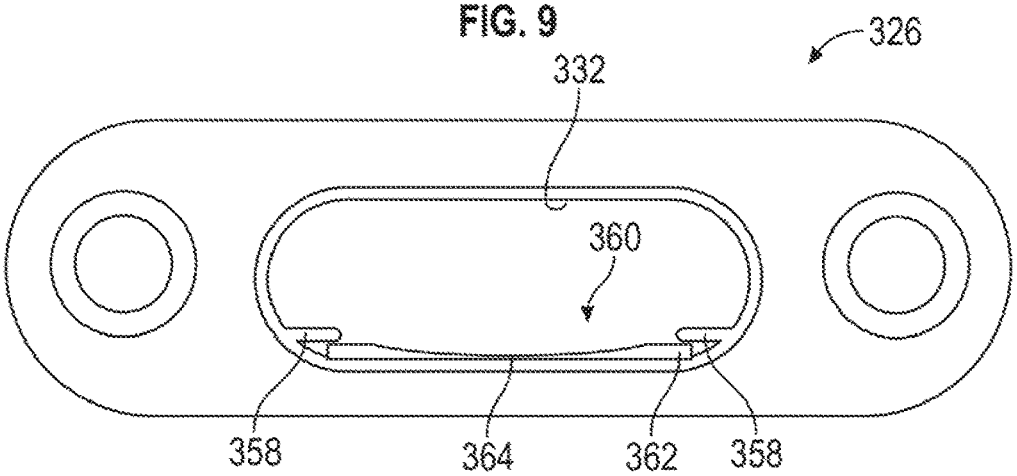
FIG. 10 is a top down view of a striker component in accordance with one or more embodiments of the present disclosure.

FIGS. 9 and 10 show multiple views of a striker component 326 in accordance with one or more embodiments of the present disclosure. FIG. 9 shows a perspective above view of the striker component 326, and FIG. 10 shows a top down view of the striker component 326. The striker component 326 may be similar to the striker component 226 shown above in FIGS. 5-7. However, in this embodiment, the striker component 326 may include one or more guides 358, such as positioned within a cup 332. In particular, two guides 358 are shown as positioned within and coupled to the cup 332, in which the guides 358 may be used to facilitate receiving a shim 360 within the cup 332. More than two guides 358 may also be positioned within and coupled to the cup 332, such as by having a pair of guides 358 formed on each side of the cup 332 (two guides 358 formed within the cup 332 adjacent a smaller width portion 348, as shown, and two guides formed within the cup 332 adjacent a larger width portion 346).

Figure 11:
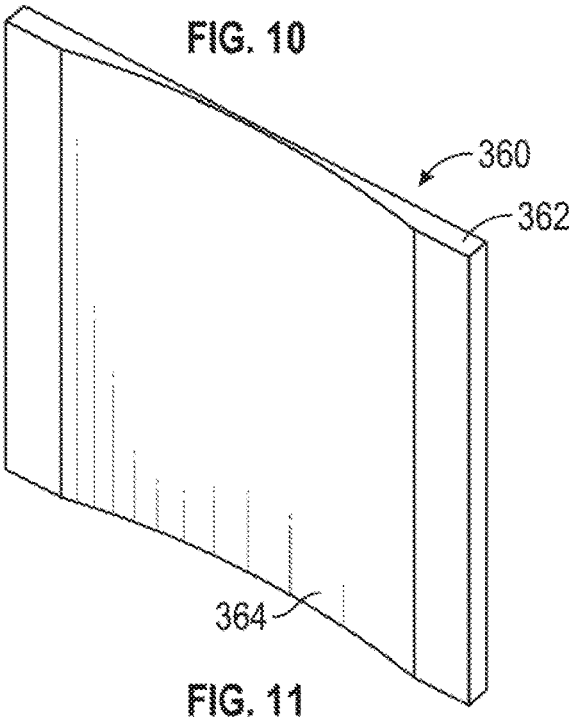
FIG. 11 is a perspective view of a shim for a striker component in accordance with one or more embodiments of the present disclosure.

FIG. 11 shows a perspective view of the shim 360 in accordance with one or more embodiments of the present disclosure. The shim 360 may be used to modify or adjust tolerances or engagement, as desired, between the cup 332 and the latch 110 received within the cup 332, such as to prevent having the latch 110 stick or jam within the cup 332. The shim 360 may have a consistent thickness. However, as shown in FIG. 11, the shim 360 may also have a variable thickness in accordance with one or more embodiments of the present disclosure. For example, the shim 360 may have edges 362 that are received within the guides 358 and a middle portion 364 extending between the edges 362. The middle portion 364 of the shim 360 may have a varied or different thickness than the edges 362. In particular, the middle portion 364 of the shim 360 may have a thinner or smaller thickness than the edges 362, as shown in FIG. 11, or a thicker or larger thickness than the edges 362 in another embodiment. The thickness of the shim 360 may, thus, be varied, based upon the tolerances or engaged desired between the cup 332 and the latch 110 received within the cup 332. Further, the shim 360 may be 3D printed or machined to facilitate manufacturing of the shim 360 as desired for the various tolerances or engagement.

Figure 12:
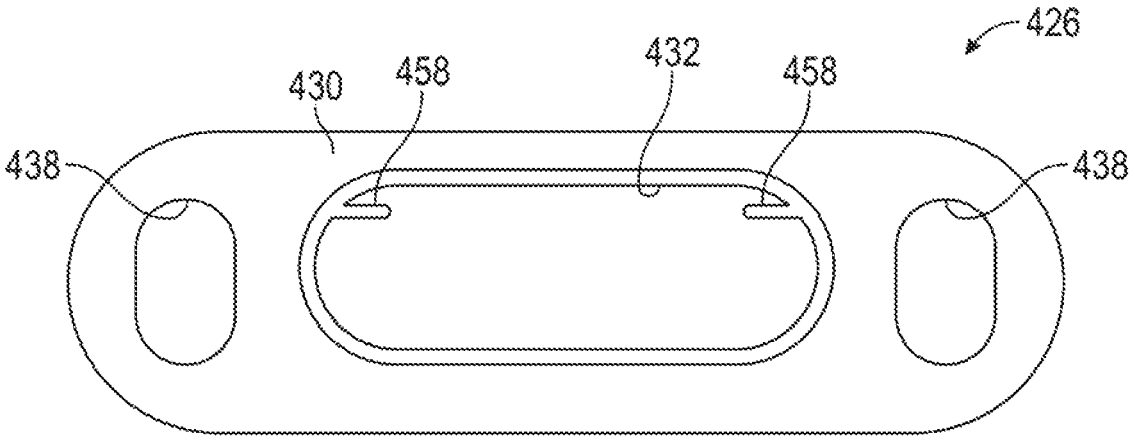
FIG. 12 is a top down view of a striker component in accordance with one or more embodiments of the present disclosure.

FIG. 12 shows a top down view of a striker component 426 in accordance with one or more embodiments of the present disclosure. As with the above embodiments, the striker component 426 may be similar to the striker component 226 shown above in FIGS. 5-7 and includes a plate 430, a cup 432, and guides 458 positioned within the cup 432. Further, the striker component 426 includes apertures 438 formed through the plate 430 to facilitate coupling the striker component 426 to a threshold assembly. In this embodiment, the apertures 438 are shown as elongated slots to adjust a position of the striker component 426 with respect to the threshold assembly. For example, a fastener may still be positioned through the aperture 438 when coupling the striker component 426 to the threshold assembly, but the position of the fastener may be adjusted within the aperture 438, such as to adjust facilitate adjusting the position of the striker component 426 with respect to the threshold assembly. As with one or more features of the above embodiments, the position of the striker component 426 may be adjustable with respect to the threshold assembly to modify or adjust tolerances or engagement, as desired, between the cup 432 and the latch 110 received within the cup 432.

The embodiments discussed above have been described in the context of use with a closet unit or a door of a vehicle, such as an aircraft. However, the present disclosure is not so limited, as a threshold assembly in accordance with the present disclosure may be used with any latching mechanism and/or door. For example, a threshold assembly in accordance with the present disclosure may be incorporated into modular or temporary structures, such as for office work stations or buildings.

While the present disclosure has been described in detail in connection with only a limited number of embodiments, it should be readily understood that the present disclosure is not limited to such described embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof.

Therefore, it is intended that the present disclosure not be limited to the particular embodiment described as the best mode contemplated for carrying out this present disclosure, but that the present disclosure will include all embodiments falling within the scope of the claims.

What is claimed is:

1. A closet unit for a vehicle, comprising:

a housing comprising a frame and a door configured to move with respect to the frame;

a latching mechanism coupled to the door and comprising a latch configured to secure the door to the frame; and a threshold assembly coupled to the housing and configured to receive the latch of the latching mechanism, the threshold assembly comprising:

a threshold body coupled to the frame and comprising an opening formed therethrough and comprising a recess positioned adjacent the opening, wherein:

the threshold body comprises an internal side and an external side; and the opening comprises a first side and a second side, and the first side of the opening is closer to the internal side of the threshold body than the second side of the opening; and a striker component removably coupled to the threshold body and comprising a plate, a cup coupled to the plate with the cup offset from a center of the plate and positionable through the opening, and a guide comprising a pair of ribs, wherein:

the plate of the striker component is configured to be positioned within the recess and entirely surrounded by the recess of the threshold body;

the striker component is configured to be removably coupled to the threshold body in a first orientation and a second orientation with respect to the threshold body;

in the first orientation, a first side of the cup is adjacent to the first side of the opening; and in the second orientation, a second side of the cup is adjacent to the first side of the opening.

2. The closet unit of claim 1, wherein:

the plate comprises a length and a width; and the center of the plate comprises a center of the width of the plate.

3. The closet unit of claim 1, wherein the cup being offset from the center of the plate defines a larger width portion of the plate adjacent to the second side of the cup and a smaller width portion of the plate adjacent to the first side of the cup.

4. The closet unit of claim 1, wherein the opening of the threshold body is larger than an outer surface of the cup.

5. The closet unit of claim 1, wherein the plate and the cup of the striker component are integrally formed with each other.

6. The closet unit of claim 1, further comprising a fastener configured to removably couple the striker component to the threshold body, wherein:

the threshold body comprises an aperture formed therethrough;

the plate of the striker component comprises an aperture formed therethrough; and the fastener is configured to be positioned through the aperture of the threshold body and the aperture of the plate to removably couple the striker component to the threshold body.

7. The closet unit of claim 6, wherein the aperture of the plate comprises a slot.

8. The closet unit of claim 1, wherein the guide is positioned within the cup of the striker component and configured to receive a shim within the cup of the striker component when the striker component is coupled to the threshold body.

9. The closet unit of claim 8, wherein the shim comprises an edge and a middle portion with the middle portion having a different thickness than the edge.

10. A threshold assembly for use with a door, comprising:

a threshold body configured to be coupled to a frame of a closet unit and comprising an opening formed therethrough and comprising a recess positioned adjacent the opening, wherein:

the threshold body comprises an internal side and an external side; and the opening comprises a first side and a second side, and the first side of the opening is closer to the internal side of the threshold body than the second side of the opening; and a striker component comprising:

a plate configured to be removably coupled to the threshold body, wherein the plate of the striker component is configured to be positioned within the recess and entirely surrounded by the recess of the threshold body;

a guide comprising a pair of ribs; and a cup coupled to and offset from a center of the plate with the cup configured to be positioned through the opening of the threshold body, wherein:

the striker component is configured to be removably coupled to the threshold body in a first orientation and a second orientation with respect to the threshold body;

in the first orientation, a first side of the cup is adjacent to the first side of the opening; and in the second orientation, a second side of the cup is adjacent to the first side of the opening.

11. The threshold assembly of claim 10, wherein the guide is positioned within the cup of the striker component and configured to receive a shim within the cup of the striker component after the striker component is coupled to the threshold body.

12. The threshold assembly of claim 11, further comprising a fastener configured to removably couple the plate of the striker component to the threshold body, wherein:

the threshold body comprises an aperture formed therethrough;

the plate of the striker component comprises an aperture formed therethrough; and the fastener is configured to be positioned through the aperture of the threshold body and the aperture of the plate to removably couple the striker component to the threshold body.

13. The threshold assembly of claim 10, wherein:

the cup being offset from the center of the plate defines a larger width portion of the plate positioned on one side of the cup and a smaller width portion of the plate positioned on an opposite side of the cup with respect to the larger width portion;

in the first orientation, the larger width portion of the plate is positioned closer to the internal side of the threshold body than the smaller width portion of the plate; and in the second orientation, the smaller width portion of the plate is positioned closer to the internal side of the threshold body than the larger width portion of the plate.

14. The threshold assembly of claim 10, wherein:

the threshold body comprises a recess positioned adjacent the opening; and the plate of the striker component is configured to be positioned within the recess.

15. A threshold assembly consisting essentially of:

a threshold body configured to be coupled to a frame of a closet unit and comprising an opening formed therethrough and a recess positioned adjacent the opening;

a striker component comprising:

a plate configured to be removably coupled to the threshold body, wherein the plate is configured to be positioned within the recess and entirely surrounded by the recess of the threshold body;

a cup coupled to and offset from a center of the plate with the cup configured to be positioned through the opening of the threshold body;

a guide positioned within the cup, wherein the guide comprises a pair of ribs; and a shim configured to be received by the pair of guides within the cup when the plate is coupled to the threshold body and the cup is positioned through the opening of the threshold body; and a fastener configured to removably couple the plate of the striker component to the threshold body.

16. The threshold assembly of claim 15, wherein:

the threshold body comprises an aperture formed therethrough;

the plate of the striker component comprises an aperture formed therethrough; and the fastener is configured to be positioned through the aperture of the threshold body and the aperture of the plate to removably couple the striker component to the threshold body.

17. The threshold assembly of claim 15, wherein:

the cup being offset from the center of the plate defines a larger width portion of the plate positioned on one side of the cup and a smaller width portion of the plate positioned on an opposite side of the cup with respect to the larger width portion;

the threshold body comprises an internal side and an external side;

the striker component is configured to be removably coupled to the threshold body in a first orientation and a second orientation with respect to the threshold body;

in the first orientation, the larger width portion of the plate is positioned closer to the internal side of the threshold body than the smaller width portion of the plate; and in the second orientation, the smaller width portion of the plate is positioned closer to the internal side of the threshold body than the larger width portion of the plate.

* * * * *